United States Patent [19]

Johnson

[11] 4,155,424

[45] May 22, 1979

[54] ADJUSTABLE-WIDTH SCAFFOLD

[75] Inventor: Wallace J. S. Johnson, Berkeley, Calif.

[73] Assignee: Up-Right, Inc., Berkeley, Calif.

[21] Appl. No.: 883,958

[22] Filed: Mar. 6, 1978

[51] Int. Cl.[2] ..... E06C 1/397; E06C 5/04

[52] U.S. Cl. ..... 182/68; 182/127; 182/152

[58] Field of Search ..... 182/17, 127, 178, 179, 182/68, 152; 52/637, 638

[56] References Cited

U.S. PATENT DOCUMENTS

| | | | |
|---|---|---|---|
| 2,310,119 | 2/1943 | Reinhardt | 182/17 |
| 2,750,204 | 6/1956 | Ohrmann | 182/17 |
| 2,964,122 | 12/1960 | Funk | 182/68 |
| 3,007,540 | 11/1961 | Reinhardt | 182/68 |
| 3,157,248 | 11/1964 | Nesslinger | 182/152 |
| 3,327,810 | 6/1967 | Johnson | 182/17 |
| 3,752,261 | 8/1973 | Bushnell | 182/17 |

*Primary Examiner*—Reinaldo P. Machado
*Attorney, Agent, or Firm*—Phillips, Moore, Weissenberger, Lempio & Majestic

[57] ABSTRACT

A mobile scaffold having a main frame with an elevated work station. Widener frames are detachably and pivotally connected to the main frame, forming a secure and integral part of the scaffold, the widener frames each having a vertically adjustable ground-engaging caster thereon to support the full weight of the scaffold. The widener frames are pivotal to an inward position narrowing the width of the scaffold to enable the scaffold to be rolled through narrow doors or aisles and pivotal outwardly to a position which widens the base and affords maximum stability for the scaffold when in use.

21 Claims, 12 Drawing Figures

ADJUSTABLE-WIDTH SCAFFOLD

BACKGROUND OF THE INVENTION

This invention relates to mobile scaffolds adapted to roll on caster wheels from one location to another, the caster wheels being vertically adjustable so that the scaffold may be leveled at the point of use.

Generally, such scaffolds have a pair of spaced-apart vertical frames supporting an elevated work station therebetween and vertically adjustable caster wheels at the corners of the scaffold. One example of such a scaffold is a mobile ladder unit, such as shown in U.S. Pat. No. 2,964,122 or U.S. Pat. No. 3,327,810 wherein a vertical ladder is supported between two wheeled side frames. Another example of such a scaffold is a platform scaffold wherein an elevated horizontal work platform is supported by two wheeled end frames, such as shown in U.S. Pat. No. 3,454,131.

An important factor in the design of scaffolds is the height-to-width ratio, i.e., the ratio of the height of the work area to the minimum base width of the scaffold. In order that the scaffold have sufficient stability to prevent tipping over, it is usually recommended that such ratio not exceed 3 to 1.

The maximum width of the scaffold is oftentimes dictated by the necessity that the scaffold be movable through relatively narrow standard doors or along narrow aisles or corridors. In order to use such a scaffold in a high-ceiling location, the ladder or platform must be raised to a height sufficient to enable the desired work to be carried out. If this height exceeds the 3 to 1 ratio, conventional practice has been to use outriggers or outboard supports to widen the base of the scaffold and thereby reduce the height-to-width ratio to a safe amount.

Mobile scaffolds also must be provided with vertically adjustable legs in order to provide a solid horizontal base for the scaffold regardless of the uneven slope, or stepped nature of the floor or ground where the scaffold is positioned. This requirement of vertical adjustability also applies to any outrigger or outboard support attached to the scaffold to increase the base width thereof.

An outrigger is conventionally a diagonally disposed prop or brace clamped onto the scaffold to extend outwardly and downwardly therefrom into engagement with the ground. The above-mentioned U.S. Pat. Nos. 2,964,122 and 3,327,810 illustrate examples of such outriggers, two being used, one on each side of the scaffold. In the case of a platform scaffold, of the type shown in U.S. Pat. No. 3,454,131, such outriggers would be used at each of the four corners of the scaffold.

If the diagonal bracing member is telescopic, e.g., as in U.S. Pat. No. 3,327,810, it has the capability of vertical adjustment, but with the corresponding disadvantage that outward distance of the outrigger foot from the scaffold will vary considerably, depending on the slope of the ground, and interference with vertical obstacles may result. Another disadvantage of a conventional outrigger is that if it has no telescopic diagonal adjustment, i.e., as in U.S. Pat. No. 2,964,122, or a limited telescopic adjustment, it must rely for vertical adjustability on being frictionally clamped to a vertical member of the scaffold. As a consequence, a suitable range of clamping positions may not be available because of cross tubes or the like secured to the vertical member.

A further disadvantage of conventional outriggers is that it is not feasible to provide them with caster wheels. Therefore, all conventional outrigger designs are provided with a "crutch-tip" or "ladder shoe" or other stub end which contacts the floor. In consequence, there is the necessity for readjusting and/or reclamping each outrigger (as well as adjusting the various casters) each time the scaffold is repositioned.

A rolling scaffold using outriggers, both in being moved and in working position, carries its full weight on the main scaffold casters. The outriggers do not function to provide vertical support to the scaffold.

A conventional outboard support is a vertically oriented rectangular frame having one side thereof attached to a vertical corner of the scaffold and a downwardly depending vertically adjustable ground-engaging member at its other side. As with outriggers, the outboard support is clamped or otherwise attached to the scaffold frame at two vertically spaced points. Oftentimes the outboard support is provided with a vertically adjustable leg-and-caster arrangement and may therefore be rollable with the scaffold on a smooth floor. However, at each work position of the scaffold, each scaffold leg must be adjusted and each scaffold caster must be locked. Likewise, each outboard support leg must be adjusted and each outboard support caster must be locked. Thus, again, conventional outboard supports double the number of caster-lockings and caster-unlockings and leg adjustments that must be made at each working position to achieve a firm base for the scaffold. Even then, it is not possible, under normal use, to be sure that the weight of the scaffold is uniformly distributed on the various scaffold and outboard support legs.

Outboard supports are neither designed nor available to serve as the sole vertical supports for the weight of the scaffold and workman thereon and therefore the maximum amount of stability that could be available from this outward engagement with the ground cannot be realized. The reason for this lack of capability of outboard supports to act as the sole vertical support for the scaffold is that if the lower fastening of the outboard support (in tension) should fail, the scaffold would tip over. Likewise, if the upper fastening (in compression) should fail, the scaffold would fall over.

A further disadvantage of a conventional outboard support is the problem of its pivotal orientation to the scaffold. If it must be clamped to the scaffold at a certain horizontal angle relative thereto, it will often interfere with a nearby obstacle. If it is pivotally adjustable, a separate brace is necessary to fasten the support to the scaffold to hold it in that pivoted position since the limited vertical force exerted between the support caster and the ground will not usually resist pivotal movement of the support if it is accidentally hit.

The only conventional alternative to the use of outriggers or outboard supports has been to supply users with special wider-base frames, to be installed when a wider scaffold is needed. Although this does enable higher platforms to be used and offers the economy of using only four adjustable legs and casters on a four-corner scaffold, it is an impracticability for a mobile scaffold which must be rolled through doorways and narrow aisles to be economically useful.

As a consequence of the limitations of outriggers, outboard supports and wide-base frames there has been an unfulfilled need for a mobile scaffold which can be easily and safely narrowed for rolling movement and widened for use and which requires no more adjustment than would be necessary for a scaffold without outward support.

It is the main object of the present invention to provide such a scaffold.

SUMMARY OF THE INVENTION

The present invention provides a plurality of widener frames which are mounted on corners of a main scaffold frame for pivotal movement about a vertical axis relative to the main frame, each widener frame having a vertically adjustable leg and caster wheel at its outer end. The widener frames are attached to the scaffold and when attached become an integral secure part of the scaffold with the full weight of the scaffold being transferred from the scaffold to and through the widener frames to their casters. With the full weight being carried by the widener frame casters, no casters are needed on the main frame as has been the case heretofore (although casters already on the main frame may be left on, in retracted position), and thus the number of adjustments needed to conform the scaffold to non-level ground is reduced to a minimum.

The widener frames can pivot to a positively limited position equal to (but not less than) the minimum width of the scaffold for movement through narrow doors or aisles. When at a work position the widener frame can be pivoted outwardly to a positively limited position which will provide the maximum stability to the scaffold. When so moved, the widener frame will automatically latch to the main frame to provide a double-locked engagement of the lower part of the widener frame to the main frame to decrease substantially any possibility that the connection between the widener frame and main frame may fail.

A further aspect of the invention is that the widener frames are easily attachable to and detachable from the main frame without the use of tools so that the scaffold can be stored or transported in a minimum space.

Other objects and advantages will become apparent in the course of the following detailed description.

BRIEF DESCRIPTION OF THE DRAWINGS

In the drawings forming a part of this application and in which like parts are designated by like reference numerals throughout the same.

DESCRIPTION OF THE PREFERRED EMBODIMENT

Figure 1:
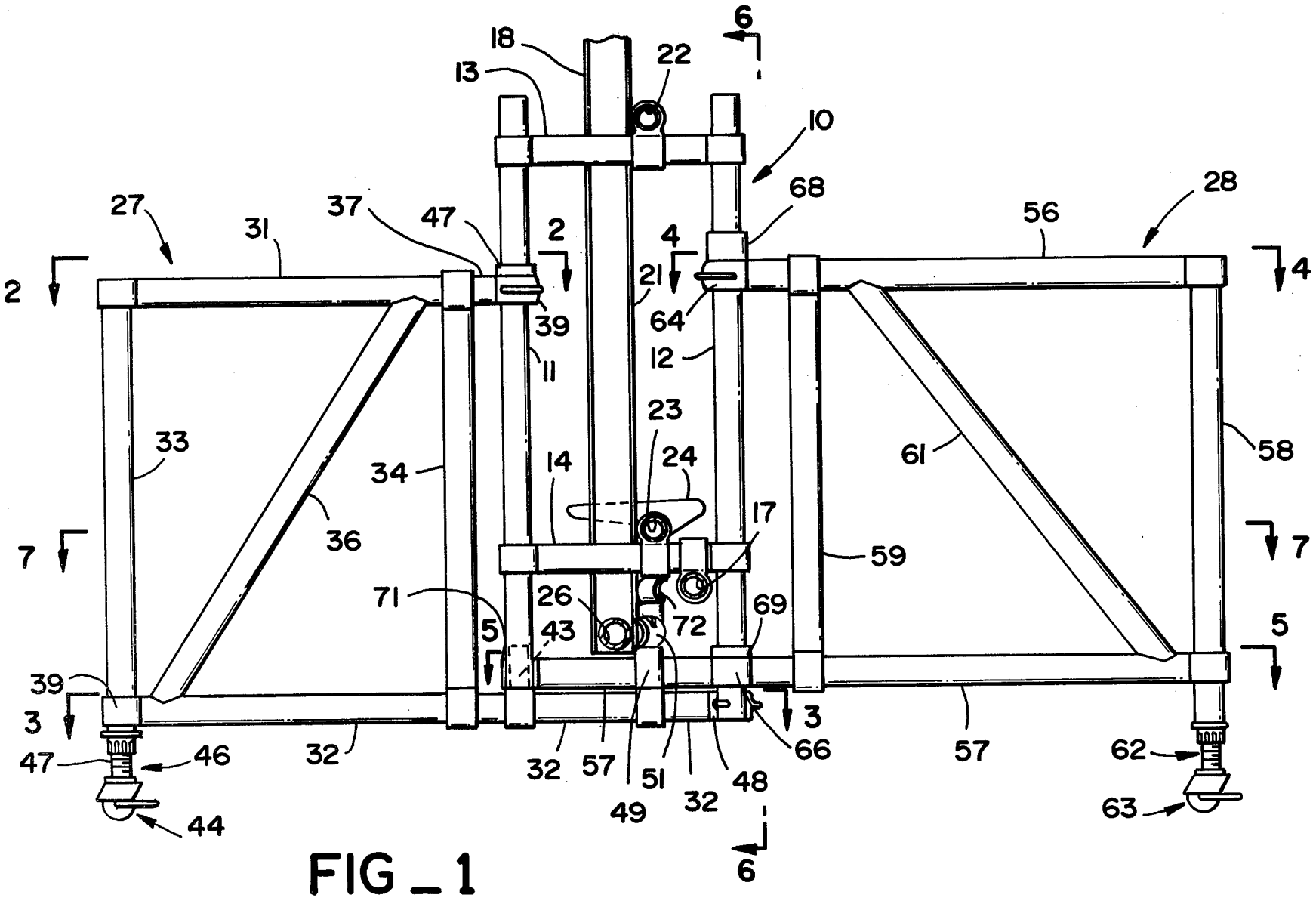
FIG. 1 is a side elevational view of a pivotal ladder scaffold having widener frames thereon in accordance with the invention.

Referring now to the pivotal ladder scaffold of FIGS. 1–7, the main frame 10 comprises vertical support tubes 11 and 12 lying in a vertical plane forming one side of the main frame and vertical support tubes 11*a* and 12*a* lying in a vertical plane parallel to and spaced from the plane of tubes 11 and 12 to form the other side of the main frame. The scaffold is symmetrical about the central vertical plane thereof and only one side will be described in detail. Corresponding mirror-image elements on the other side will be identified by the same reference numerals with a subscript "a".

Figure 6:
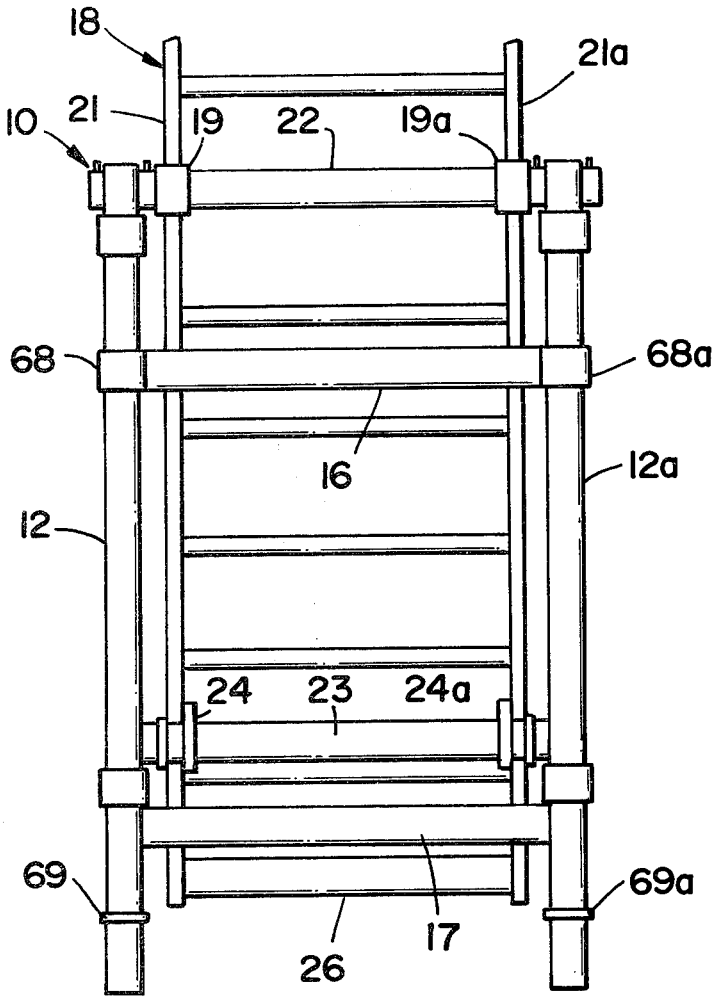
FIG. 6 is a rear elevational view, as seen from line 6—6 of FIG. 1, of the main frame end ladder, with the widener frames removed therefrom.
Figure 2:
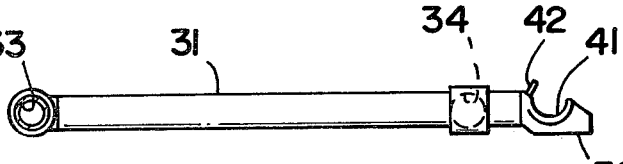
FIG. 2 is a view from above, as seen from line 2—2 on FIG. 1 of the top portion of one of the front widener frames.

As best seen in FIG. 1, upper and lower horizontal tubes 13 and 14 extend between and are fixed to tubes 11 and 12. As seen in FIG. 6, upper and lower horizontal cross tubes 16 and 17 extend between the sides of the main frame, cross tube 16 being fixed to support tubes 12 and 12*a*, while cross tube 17 is fixed to horizontal tubes 14 and 14*a* near vertical support tubes 12 and 12*a*.

A ladder unit 18 is provided with trunnions 19 and 19*a*, fixed to side rails 21 and 21*a* of the ladder, and mounted on cross tube 22 which extends between and is fixed to tube 13 and the corresponding tube on the other side of the frame. Such trunnion connection enables the ladder unit to be pivoted from a horizontal position (not shown) to the vertical position illustrated in the drawings. When in such vertical position the rails of the ladder engage cross tube 23 (extending between and fixed to tubes 14 and 14*a*) and the ladder is detachably latched thereto, as by ladder locks 24 and 24*a* pivotally mounted on the ladder rails. The lower end of ladder unit 18 includes a horizontal cross tube 26 extending between the ladder rails, which cross tube is fixed relative to the main frame 10 when the ladder is locked in vertical position, such cross tube being used to latch the front widener frames in position as described hereinafter.

Front widener frames 27 and 27*a* are associated with the front vertical support tubes 11 and 11*a* of the main frame 10 and rear widener frames 28 and 28*a* are associated with the rear support tubes 12 and 12*a* as now described.

As best seen in FIG. 1, front widener frame 27 comprises upper and lower horizontal tubular frame members 31 and 32, inner and outer vertical tubular members 33 and 34 and a diagonal, load-bearing, tubular member 36 extending generally from the upper inner corner 37 of the frame to the lower outer corner 38 thereof. A horizontally disposed detachable locking hook 39 is fixedly mounted on the upper corner of the widener frame for attachment to support tube 11, locking hook 39 encircling such tube and allowing the widener frame to pivot about the vertical axis of tube 11. Preferably, and as shown herein in FIG. 2, such locking hooks have an open hook 41 with a radius generally equal to that of the tube to which the hook is to be attached and an axially movable retainer pin 42 which is spring-pressed outwardly as shown to prevent removal of the hook when latched onto a tube, pin 42 being depressed inwardly by engagement with the tube as the hook is hooked onto the tube and being manually depressable to allow the hook to be removed from the tube. Such hook is more fully shown in U.S. Pat. No. 2,665,950, the disclosure of which is incorporated herein by reference.

An upwardly extending stub 43 is fixed to the lower horizontal frame member 32 and fits upwardly into the lower end of support tube 11, stub 41 allowing the widener frame to pivot about the vertical axis of tube 11.

As may be seen, widener frame 27 may be easily attached to support tube 11, without the need for tools, by simply inserting stub 43 into the bottom of tube 11 and by snapping the locking hook 39 onto tube 11. Likewise, widener frame 27 can be easily detached from the main frame without tools by moving the widener frame downwardly so that stub 43 comes out of tube 11 and by manually releasing the latching hook from the support tube.

A downwardly depending and ground-engaging caster 44 is mounted on the lower outer corner 39 of the widener frame 27 by means of a vertically-adjustable leg member 46. Preferably, caster 44 is of the locking type shown more fully in U.S. Pat. No. 3,239,873, while the leg member 46 is preferably of the type shown more fully in U.S. Pat. No. 3,224,800, the disclosures of which are incorporated herein by reference. Leg member 45 has an adjustment screw 46 which extends upwardly into tubular member 33 and enables a substantial vertical adjustment of caster 44 relative to widener frame 27.

When widener frame 27 is attached to support tube 11 as shown in FIG. 1, the upper surface of locking hook 39 engages and bears upwardly against the lower surface of collar 47 the latter being fixed to tube 11. Likewise, the upper surface of the lower horizontal frame member 32 engages the lower end of support tube 11. Such bearing engagements act to positively transfer the downward force on tube 11 to the widener frame and through such frame to the caster 44 so that caster 44 supports the full downward load on tube 11. The diagonal frame member 36 is in compression while the horizontal frame member 32 is in tension between the lower corner 39 of the widener frame and pivot stub 43.

Figure 3:
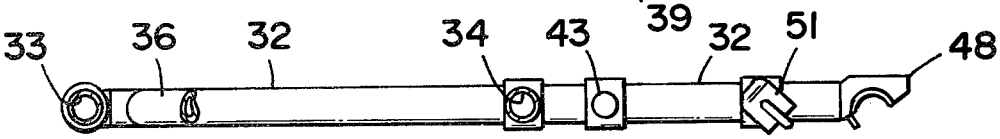
FIG. 3 is a sectional view, taken on line 3—3 of FIG. 1, illustrating the lower portion of the front widener frame.
Figure 4:
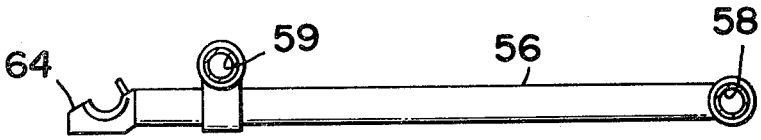
FIGS. 4 and 5, taken on lines 4—4 and 5—5 of FIG. 1, are corresponding views of one of the rear widener frames.
Figure 5:
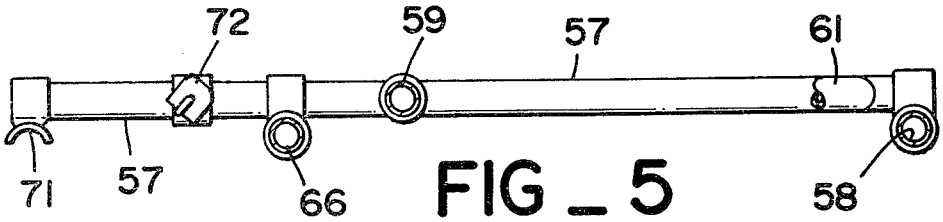

As will be noted in FIGS. 1 and 3, the lower horizontal widener frame member 32 extends beyond pivot stub 43 and has fixed to its end a horizontally disposed locking hook 48 adapted to latch onto the bottom end of vertical support tube 12 when the widener frame 27 has been pivoted to a position coplanar with support tubes 11 and 12.

Figure 7:
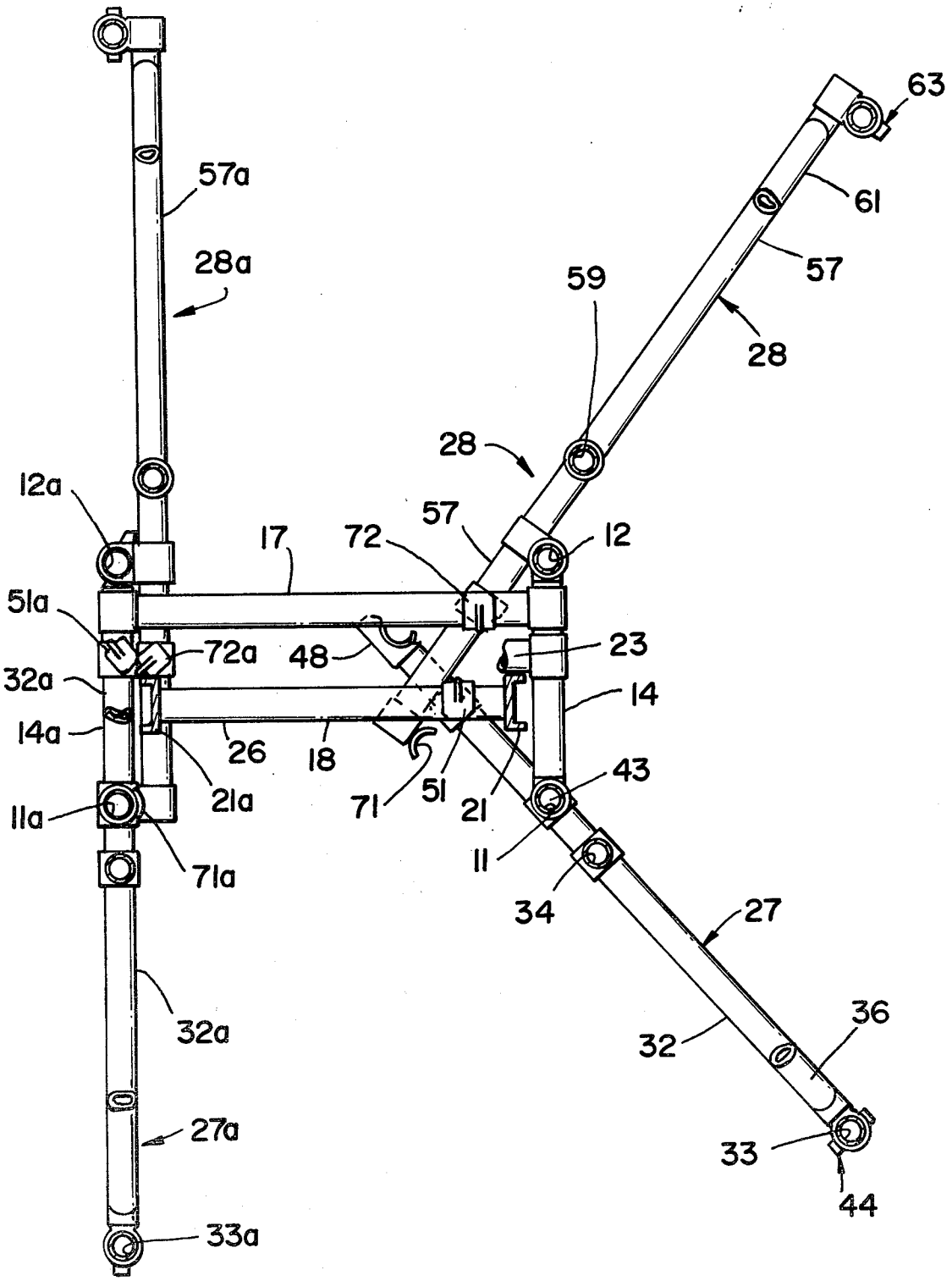
FIG. 7 is a sectional view, taken on line 7—7 of FIG. 1, illustrating the positions to which the widener frames may be moved relative to the main frame.
Figure 8:
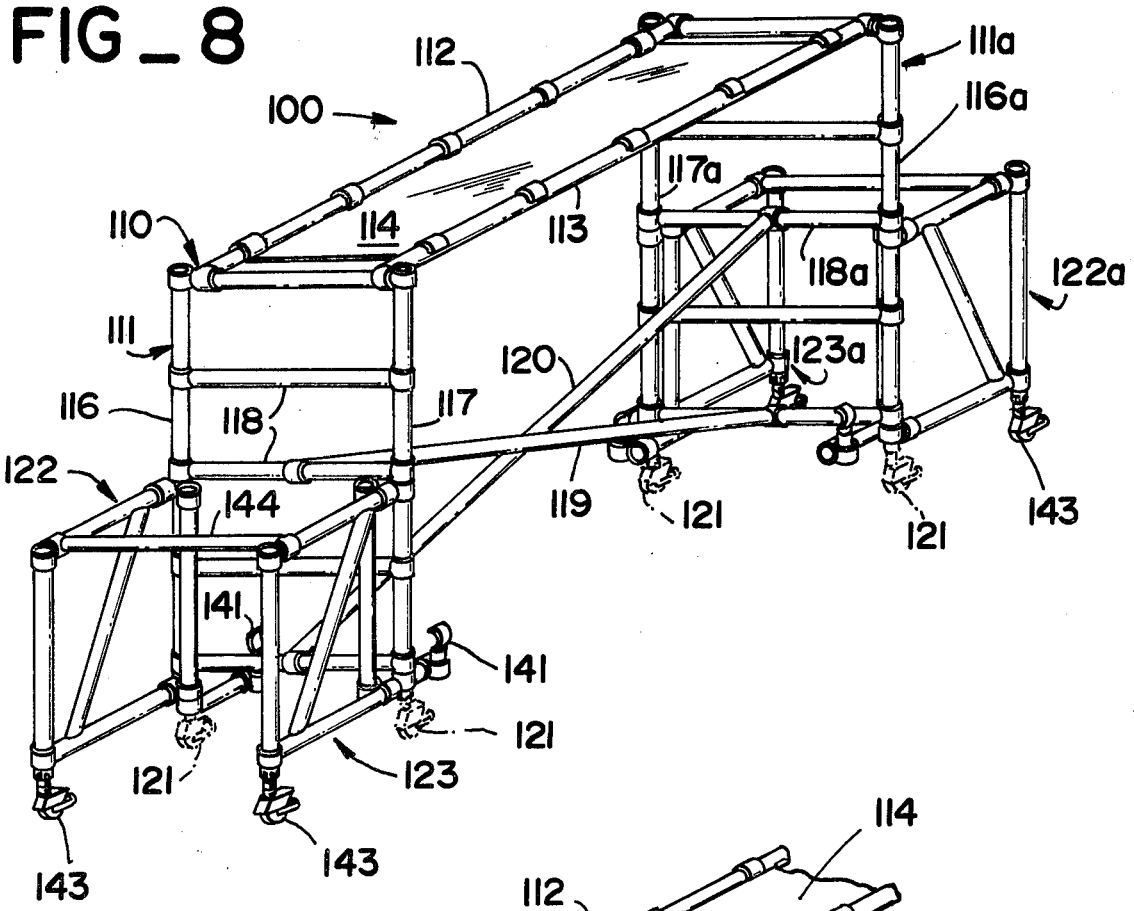
FIG. 8 is a perspective view of a platform scaffold having widener frames in accordance with the invention, and showing such widener frames in one position.
Figure 9:
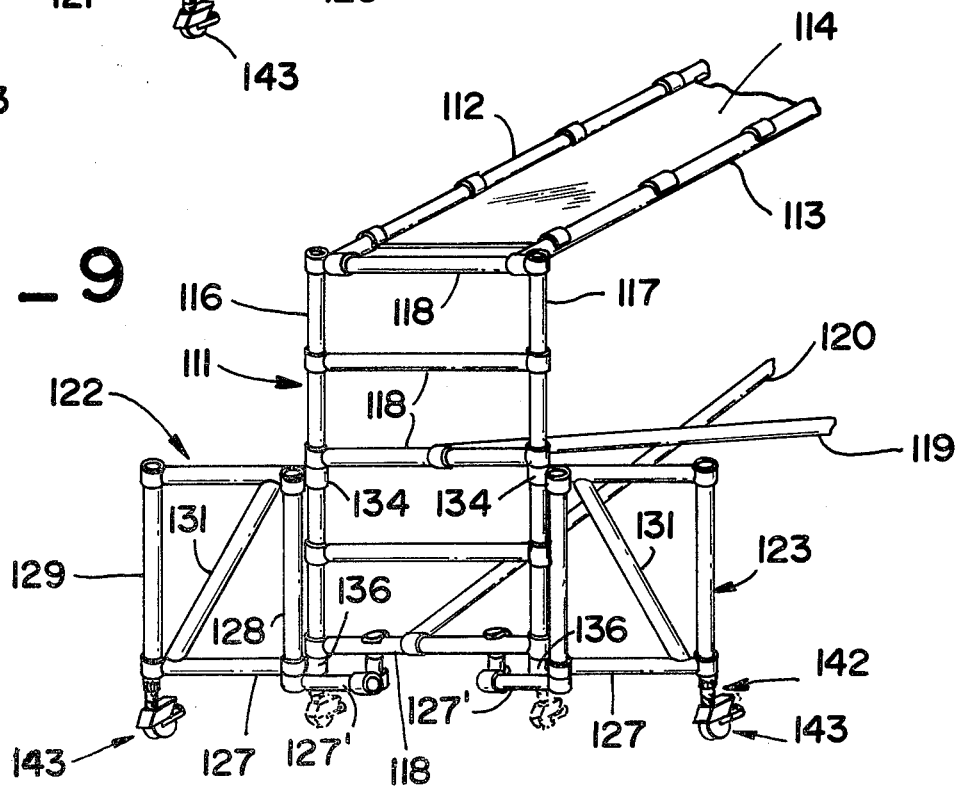
FIG. 9 is a perspective view of one end of the platform scaffold of FIG. 8, showing the widener frames in their widened position.

Also mounted on horizontal member 32 is a short vertical tube 49 having a vertically disposed locking hook 51 fixed to the upper end thereof, locking hook 51 being oriented so that when widener frame 27 is pivoted outwardly to approximately 45° relative to the plane of support tubes 11 and 12 (as shown in FIG. 7), hook 51 will latchingly engage cross tube 26 and support horizontal member 32 therefrom.

Rear widener frame 28 is substantially the same as the front widener frame 27 and comprises upper and lower horizontal frame members 56 and 57, vertical tubes 58 and 59 and diagonal tube 61, the frame having a vertically adjustable leg 62 and caster 63 at its outer lower corner. The rear widener frame 28 is detachably connected to support tube 12 by locking hook 64 at the upper corner of the widener frame which latches onto tube 12 and by collar 66 fixed to lower horizontal tube 57, collar 66 having a vertical opening 67 therethrough allowing the collar to be slid upwardly onto the lower end of support tube 12. Collars 68 and 69, fixed to support tube 12, vertically engage locking hook 64 and widener frame collar 66, respectively, to transfer the vertical load on support tube 12 to the widener frame.

Horizontal frame member 57 has a semi-circular stop member 71 on the inner end thereof adapted to engage support tube 11 when the widener frame 28 has been pivoted to a position generally in line with the plane of support tubes 11 and 12. Horizontal frame member 57 also has a vertically disposed locking hook 72 extending upwardly therefrom, such hook being oriented to engage and latch to cross tube 17 when the widener frame has been pivoted outwardly 45°.

Figure 11:
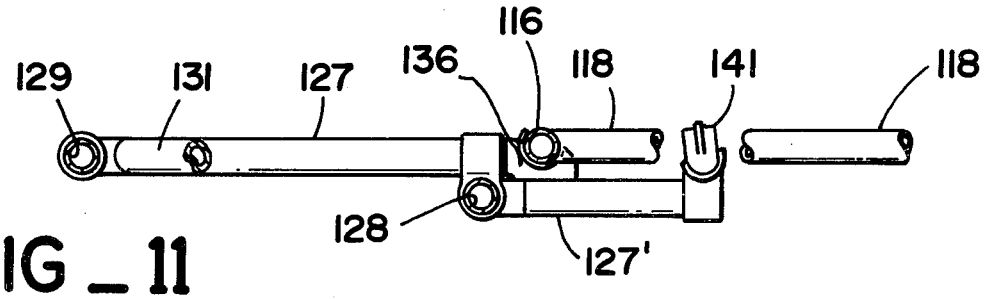
FIG. 11 is a sectional view, taken on line 11—11 of FIG. 10.

As will be noted in FIG. 11, widener frames 27 and 28 are constructed and mounted on support tubes 11 and 12 so that the lower horizontal widener frame members 32 and 57 lie in different vertically spaced horizontal planes to allow the desired pivotal movement of such frame members without interference between the ends thereof.

The front and rear widener frames **27*a* and 27*b* are mirror images of the front and rear widener frames 27 and 28** just described.

In use of the scaffold shown in FIGS. 1–7, the scaffold is preferably brought, as by truck, to the general work site with the widener frames detached from the main frame. After arrival and unloading, the widener frames 27, 28, **27*a* and 28*a* are attached to support tubes 11, 12, 11*a* and 12*a*** respectively. Since each of the four widener frames are slightly different, the support tubes and widener frames are preferably color-coded so that the workman can easily tell which widener frame goes on which support tube.

If the scaffold is then to be moved to its work destination through doorways or the like, the widener frames are pivoted to the position wherein the widener frames are in line with the sides of the main frame so that the width of the entire scaffold is the same as the width of the central main frame. The stop members 48 and 71 on the ends of the horizontal members 32 and 57 prevent the front and rear pairs of casters from being brought together more closely than the width of the main frame so that the scaffold will be stable as it is rolled from place to place. The ladder unit 18 is also pivoted to horizontal position to reduce the total height of the scaffold during movement.

When at the desired work place, the ladder unit is pivoted to vertical position and locked into place to the main frame. If all four widener frames are to be spread, latching hooks 48 and **48*a* are detached from tubes 12 and 12*a*. The workman can then push outwardly on the vertical widener frame members 33 and 33*a* to pivot both widener frames 27 and 27*a* outwardly. When they have been pivoted outwardly by approximately 45° the latching hooks 51 will engage and latch onto cross tube 26**.

During such movement of widener frame 27, the tubular member 49 thereon will engage the low horizontal frame member 57 of widener frame 28 and force the latter widener frame to pivot outwardly. Tubular member 49 is positioned on frame member 57 such that when widener frame 27 becomes latched to cross tube 26, the locking hook 72 on the rear widener frame 28 will engage and latch to cross tube 17. In like manner, outward pivotal movement of front widener frame 27*a* will cause rear widener frame 28*a* to pivot outwardly and latch into place.

The casters on the widener frames are then locking against rolling movement and the vertically adjustable caster legs are adjusted for height, if necessary, and the scaffold is ready for use.

If the scaffold is to be positioned adjacent a vertical wall, then only the widener frames on the side of the scaffold away from the wall will be opened, e.g., as illustrated in FIG. 7.

As previously mentioned, the positive vertical engagement of each widener frame with the vertical support tube on which it pivots provides the necessary up-thrust to support that corner of the scaffold. In addition, when the widener frame is extended and latched into place it will be double-locked at the bottom of the widener frame. For example, when locking hook 51 on widener frame 27 is latched to cross tube 26, such hook will support horizontal member 32 against downward movement relative to the main frame and will reduce the shear force on pivot stub 43. With such double-lock arrangement, both the pivot connection and the hook connection would have to fail simultaneously for the scaffold to tip over at this corner. The other widener frames are likewise doubly locked when latched in extended position.

After use, the scaffold may be easily moved to another work position. If space permits, the casters are unlocked and the scaffold rolled to its new position with the widener frames extended. Otherwise, the locking hooks 51, 51*a*, 72 and 72*a* are unlatched and the widener frames are pivoted inwardly.

After use of the scaffold is completed, the scaffold may be easily disassembled by detaching the widener frames from the main frame so that the disassembled units may be transported to the next place or stored in limited space.

FIGS. 8–12 illustrate the use of widener frames in connection with a platform scaffold. Typically, the main frame 110 of such scaffold comprises spaced-apart vertical end frames 111 and 111*a*, which support horizontal tubes 112 and 113 extending therebetween, with a platform 114 carried by tubes 112 and 113. End frame 111 comprises spaced-apart vertical support tubes 116 and 117 and a plurality of cross tubes 118 extending between and fixed to the support tubes. Diagonal braces 119 and 121 extend between the end frames and are attached to suitable of the cross tubes thereof to provide rigidity to the scaffold. End frame 111*a* is similarly formed with vertical support tubes 116*a* and 117*a* and cross tubes 118*a*. Typically, a conventional platform scaffold 100 as described above is provided with vertically adjustable casters 121 (shown in phantom) at the bottom of end frame support tubes 116, 116*a*, 117 and 117*a*, by which the scaffold may be moved from place to place.

As before, each support tube has a widener frame associated therewith, widener frames 122, 123, 122*a* and 123*a* being detachably and pivotably mounted on vertical support tubes 116, 117, 116*a* and 117*a* respectively. Widener frame 116 is identical to frame 116*a*, the same being true for frames 117 and 117*a*. Frames 116 and 117 are mirror images of each other. Corresponding elements of the various widener frames are identified by the same reference numerals.

Figure 10:
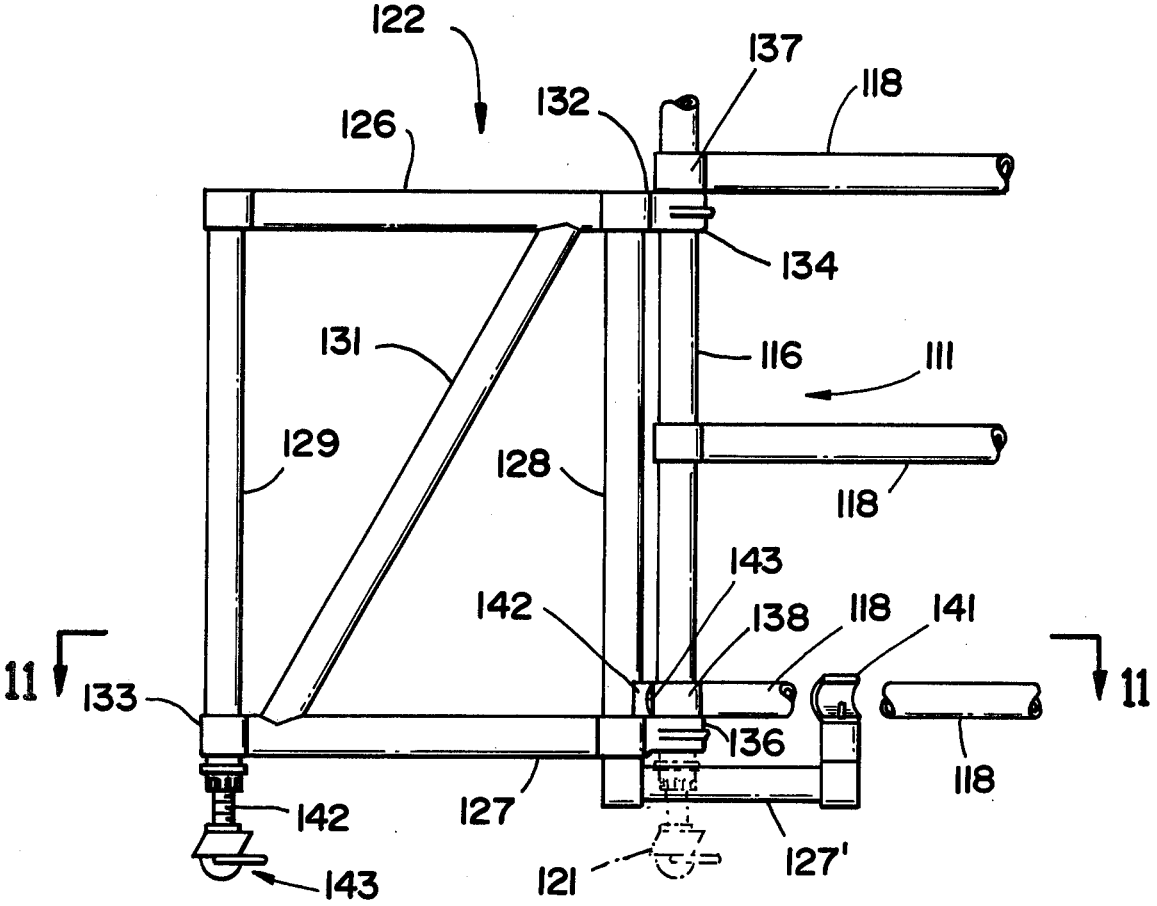
FIG. 10 is an elevational view illustrating the manner in which one of the widener frames of FIG. 8 is attached to the main frame of the platform scaffold.
Figure 12:
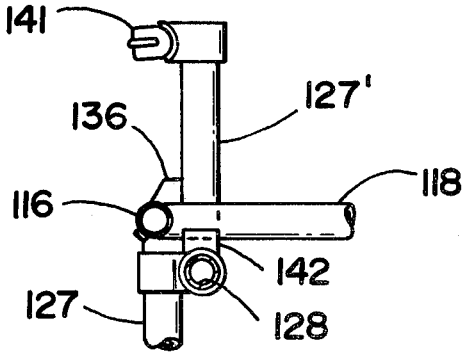
FIG. 12 is a sectional view, similar to FIG. 11 showing the widener frame povoted relative to the main frame to the position shown in FIG. 9.

With particular reference to widener frame 122, shown in FIGS. 10–12, such frame comprises upper and lower horizontal frame members 126 and 127, inner and outer vertical frame members 128 and 129 and a diagonal frame member 131 extending generally from the upper inner corner 132 of the frame to the lower outer corner 133 thereof.

A horizontally disposed locking hook 134 is mounted on the upper inner corner 132 of the widener frame to pivotally connect such corner to vertical support tube 116. Likewise a horizontally disposed locking hook 136 is mounted on lower horizontal frame member 127 to pivotally connect such frame member to support tube 116. The height of the widener frame is such that the upper surfaces of hooks 134 and 136 engage the lower surfaces of collars 137 and 138 to provide for a positive transfer of the load on support tube 116 to the widener frame and thus to the ground-engaging caster 141 at the lower outer corner of the widener frame. The vertically adjustable leg 142 enables the height of the widener frame above the caster to be adjusted as needed.

A horizontal frame member 127' is fixed to the lower end of vertical member 128, frame member 127' forming an extension of the lower horizontal frame member 127 but being offset below and to one side of member 127. A vertically disposed locking hook 141 is mounted in the end of frame member 127', hook 141 extending above frame member 127' and being oriented so that it will engage and latch onto the lowermost cross tube 118 of the end frame 111. Locking hook 141 serves both as a stop member to limit outward pivotal movement of widener frame 122 to a position wherein the widener frame 122 and end frame 111 are generally coplanar (FIG. 9), and also as a second lock to support the end of frame member 127' against downward movement and thus reduce the tension force on the pivoted connection 136.

A stop member 142 is positioned on frame member 128, such stop member having an arcuate surface 143 engageable with the lowermost cross tube 118 when the widener frame 122 has been pivoted to a position wherein its plane is perpendicular to the plane of end frame 111 (FIG. 10). Such stop member 128 thus prevents casters 141 of the widener frames at one end of the scaffold from being moved together more closely than the width of the main scaffold.

In use, the platform scaffold 100 and the widener frames 122, 122*a*, 123 and 123*a* can all be transported to the general work area in disassembled form. Although casters 121 are removable from the end frames 111 and 111*a*, they are usually left in place on the end frames during storage and transport. Similarly, removable casters 143 are usually left on the widener frames at all times. When at the general work area, widener frames 122 and 123 are latched into place on support tubes 116 and 117 of end frame 111. Likewise, widener frames 122*a* and 123*a* are latched onto tubes 116*a* and 117*a* of end frame 111*a*. The upper horizontal tubes 112 and 113 and diagonal braces 119 and 120 are put in place and platform 114 is put on to complete the scaffold.

If desired, the scaffold could be assembled by first erecting the main scaffold 100, i.e., assembling the end frames 111 and 111*a*, the horizontal tubes 112 and 113, the diagonal braces 119 and 120 and platform 100, and then latching the widener frames to the corners of the scaffold.

As is apparent, a conventional assembled platform scaffold 100 could already be at the work area and the widener frames could be brought thereto and latched in place to convert the scaffold to a widener frame scaffold.

In any event, after the scaffold is fully assembled, any of the main frame casters that are in engagement with the floor are retracted from the floor so that the weight of the scaffold is borne only by the widener frame casters 143.

The scaffold may now be rolled to its desired place of use. Preferably the widener frames are pivoted to the position shown in FIG. 10 so that the scaffold can be moved through doorways or the like. Also preferably, a removable tie bar 144 is connected between widener frames 122 and 123 when they are in the position of FIG. 10 to hold them in such position during movement of the scaffold.

When at the desired work spot, one or more of the widener frames are pivoted outwardly to provide the desired stability for the scaffold. If there is room, all four widener frames are pivoted outwardly to the FIG. 9 position, such movement causing hooks 141 to latch into place and thus provide the greatest stability to the scaffold as well as providing a double lock of the bottom of the widener frames to the main frame of the scaffold. If the scaffold is to be used against a wall, widener frames 122 and **123*a* may be left in their FIG. 8 position while widener frames 123 and 122*a* are pivoted outwardly to the FIG. 9** position. Since any of the widener frames can be pivoted through a horizontal angle of approximately 90°, an intermediate position of any widener frame can be used, if necessary, because of vertical obstructions.

The scaffold is vertically trued, by adjustment of one or more of the four adjustment legs 142, the casters 143 are locked against rolling and the scaffold is ready for use. Since the end frame casters 121 are not used when the widener frames are in place, there is no need to adjust casters 121. They are simply left in retracted position. Casters 121 do, however, provide a safety feature in that if a careless or inattentive workman should fail to latch a widener frame properly into place, downward movement of that corner of the scaffold would be limited to the amount of clearance between the floor and the retracted caster 131 thereat. For this reason, if the end frames do have casters 131 thereon, they should be left in place, but retracted so as not to interfere with normal use of the widener frame casters 143.

After use, the entire scaffold can be easily disassembled, without the need for any tools, and stored in a limited space or transported to another work area.

What is claimed is:

1. A scaffold comprising:

a main frame having a vertical support tube at each corner thereof and a lower horizontal cross tube fixed relative to a first and second of said vertical support tubes near the lower ends thereof, a vertically oriented widener frame having a lower horizontal frame member, an upper corner and load-bearing means extending from said upper corner to one end of said lower horizontal frame member, first pivot means fixed to said upper corner of said widener frame and second pivot means fixed to said lower horizontal frame member between the ends thereof for mounting said widener frame on said first vertical support tube for pivotal movement of said widener frame about the vertical axis of said support tube through a substantial horizontal angle and between first and second positions, the plane of said widener frame being substantially perpendicular to the plane of said first and second support tubes when said widener frame is in its final position, support means mounted on said lower horizontal widener frame member for engagement with said cross tube when said widener frame is in its second position and for supporting said horizontal frame member from said cross tube and against downward movement relative thereto when said support means is in engagement with said cross tube, said second pivot means being located on said horizontal frame member between said one end of said frame member and said support means, a vertically adjustable ground-engaging member fixed to and extending downwardly from said one end of said horizontal widener frame member.

2. A scaffold as set forth in claim 1 and further including:

means forming vertically engageable surfaces on said first vertical support tube and said first pivot means for positively transferring downward force on said first vertical support member to said upper corner of said widener frame when said surfaces are engaged.

3. A scaffold as set forth in claim 2 and further including:

means forming vertically engageable surfaces on said first vertical support tube and said second pivot means for positively transferring downward force on said first vertical support member to said lower horizontal widener frame member when said surfaces are engaged.

4. A scaffold as set forth in claim 1 wherein said first and second pivot means further have a function of enabling said widener frame to be attached to and removed from said first vertical support tube without the use of tools.

5. A scaffold as set forth in claim 4 wherein said first pivot means comprises a horizontally disposed detachable locking hook mounted on said upper corner of said widener frame for detachably encircling said one support tube.

6. A scaffold as set forth in claim 4 wherein said second pivot means comprises a horizontally disposed detachable locking hook mounted on said lower horizontal widener frame member for detachably encircling said one support tube.

7. A scaffold as set forth in claim 4 wherein said second pivot means comprises a collar fixed to said lower horizontal widener frame member, said collar having a vertical opening therethrough for encircling said one support tube.

8. A scaffold as set forth in claim 4 wherein said second pivot means comprises a vertically oriented stub fixed to said lower horizontal widener frame member for upward reception into the lower end of said one support tube.

9. A scaffold as set forth in claim 4 wherein said first and second pivot means each comprise a horizontally disposed detachable locking hook, mounted respectively on said upper corner and on said lower horizontal member of said widener frame, for detachably encircling said one support tube, and wherein said support means comprises a vertically disposed detachable locking hook mounted on said lower horizontal widener frame member and extending upwardly therefrom for detachably encircling said cross tube.

10. A scaffold as set forth in claim 1 wherein said support means comprises a vertically oriented detachable locking hook mounted on said lower horizontal member of said widener frame for detachably encircling said cross tube.

11. A scaffold as set forth in claim 1 and further including:

means forming interengageable surfaces on said widener frame and said main frame for stopping said widener frame at the first position thereof when pivoted thereto from its second position.

12. A scaffold as set forth in claim 1 and further including:

a second vertically oriented widener frame having a lower horizontal frame member, an upper corner and load bearing means extending from said upper corner to one end of said lower horizontal frame member, third pivot means fixed to said upper corner of said second widener frame and fourth pivot means fixed to said lower horizontal frame member thereof and between the ends thereof for mounting said second widener frame on said second vertical support tube for pivotal movement of said widener frame about the vertical axis of said second support tube through a substantial horizontal angle and between first and second positions, the plane of said second widener frame being substantially perpendicular to the plane of said first and second support tubes when said second widener frame is in its first position, second support means mounted on said lower horizontal widener frame member of said second widener frame for engagement with said cross tube when said second widener frame is in its second position and for supporting said horizontal frame member of said second widener frame from said cross tube and against downward movement relative thereto when said second support means is in engagement with said cross tube, said fourth pivot means being located on said horizontal frame member of said second widener frame between said one end of said frame member and said second support means, a vertically adjustable ground engaging member fixed to and extending downwardly from said one end of said horizontal widener frame member.

13. A scaffold as set forth in claim 12 and further including:

means forming vertically engageable surfaces on said first vertical support tube and said first pivot means for positively transferring downward force on said first vertical support member to said upper corner of said first widener frame when said surfaces are engaged, means forming vertically engageable surfaces on said first vertical support tube and said second pivot means for positively transferring downward force on said first vertical support member to said lower horizontal member of said first widener frame when said surfaces are engaged, means forming vertically engageable surfaces on said second vertical support tube and said third pivot means for positively transferring downward force on said second vertical support member to said upper corner of said second widener frame when said surfaces are engaged, means forming vertically engageable surfaces on said second vertical support tube and said fourth pivot means for positively transferring downward force on said second vertical support member to said lower horizontal member of said second widener frame when said surfaces are engaged.

14. A scaffold as set forth in claim 13 wherein said first and second pivot means further have a function of enabling said first widener frame to be attached to and removed from said first vertical support tube without the use of tools and wherein said third and fourth pivot means further have a function of enabling said second widener frame to be attached to and removed from said second vertical support tube without the use of tools.

15. A scaffold comprising:

a main frame having first, second, third and fourth vertical support tubes, said first and second tubes lying in a first vertical plane and said third and fourth tubes lying in a second vertical plane parallel to and spaced from said first plane, said main frame including means forming a first horizontal cross tube extending between said planes above the lower ends of said first and third support tubes and means forming a second horizontal cross tube extending between said planes above the lower ends of said second and fourth support tubes, a first vertically oriented widener frame having a lower horizontal frame member, an upper corner and load bearing means extending from said upper corner to one end of said lower horizontal frame member, first pivot means fixed to said upper corner of said first widener frame and second pivot means fixed to said lower horizontal frame member of said first widener frame between the ends of said horizontal member for mounting said first widener frame on said first support tube for pivotal movement of said first widener frame about the vertical axis of said first support tube from a first position wherein the plane of said first widener frame is generally parallel to said first plane to a second position wherein the plane of said first widener frame is at a substantial horizontal angle to said first plane, a first support means mounted on said lower horizontal member of said first widener frame for engaging said first cross tube when said first widener frame has been pivoted to its said second position and for supporting said other end of said horizontal member against downward movement when engaged with said first cross tube, said second pivot means being located on said lower horizontal member between said one end of said horizontal member and said first support means, a first vertically adjustable ground engaging member fixed to and extending downwardly from said one end of said horizontal member of said first widener frame, a second vertically oriented widener frame having a lower horizontal frame member, an upper corner and load bearing means extending from said upper corner to one end of said lower horizontal frame member, third pivot means fixed to said upper corner of said second widener frame and second pivot means fixed to said lower horizontal frame member of said second widener frame between the ends of said horizontal member for mounting said second widener frame on said second support tube for pivotal movement of said second widener frame about the vertical axis of said second support tube from a first position wherein the plane of said second widener frame is generally parallel to said first plane to a second position wherein the plane of said second widener frame is at a substantial horizontal angle to said first plane, a second support means mounted on said lower horizontal member of said second widener frame for engaging said second cross tube when said second widener frame has been pivoted to its said second position and for supporting said other end of said horizontal member against downward movement when engaged with said second cross tube, said fourth pivot means being located on said second widener frame horizontal member between one end of said horizontal member and said second support means, a second vertically adjustable ground engaging member fixed to and extending downwardly from said one end of said horizontal member of said first widener frame.

16. A scaffold as set forth in claim 15 and further including:

means forming vertically engageable surfaces on said first vertical support tube and said first pivot means for positively transferring downward force on said first vertical support member to said upper corner of said first widener frame when said surfaces are engaged, means forming vertically engageable surfaces on said first vertical support tube and said second pivot means for positively transferring downward force on said first vertical support member to said lower horizontal member of said first widener frame when said surfaces are engaged, means forming vertically engageable surfaces on said second vertical support tube and said third pivot means for positively transferring downward force on said second vertical support member to said upper corner of said second widener frame when said surfaces are engaged, means forming vertically engageable surfaces on said second vertical support tube and said fourth pivot means for positively transferring downward force on said second vertical support member to said lower horizontal member of said second widener frame when said surfaces are engaged.

17. A scaffold as set forth in claim 15 wherein said lower horizontal members of said first and second widener frames lie in different vertically spaced, horizontal planes, and further including means fixed to one of said lower horizontal members and engageable with the other thereof for causing said second widener frame to pivot from its first to its second position in response to pivotal movement of said first widener frame from its first to its second position.

18. A scaffold as set forth in claim 15 wherein said first widener frame includes means on the other end of said lower horizontal member thereof engageable with said second vertical support tube to stop said first widener frame at its first position when pivoted thereto from its second position and wherein said second widener frame includes means on the end of said lower horizontal member thereof engageable with said first vertical support tube to stop said second widener frame at its first position when pivoted thereto from its second position.

19. A scaffold as set forth in claim 18 wherein at least one of said means on the other end of said lower horizontal widener frame members comprises a horizontally disposed detachable locking hook adapted to detachably encircle one of said support tubes.

20. A scaffold as set forth in claim 15 wherein said first and second pivot means further have a function of enabling said first widener frame to be attached to and removed from said first vertical support tube without the use of tools and wherein said third and fourth pivot means further have a function of enabling said second widener frame to be attached to and removed from said second vertical support tube without the use of tools.

21. A scaffold as set forth in claim 15 and further including:

a ladder unit, means mounting said ladder unit for pivotal movement on said main frame between horizontal and vertical positions, means for locking said ladder unit to said main frame when said ladder unit is in its vertical position, and wherein said means forming said first cross tube is mounted on said ladder unit.

* * * * *